US009066169B2

(12) United States Patent
Dunn

(10) Patent No.: US 9,066,169 B2
(45) Date of Patent: Jun. 23, 2015

(54) SYSTEM AND METHOD FOR ENHANCING SPEECH INTELLIGIBILITY USING COMPANION MICROPHONES WITH POSITION SENSORS

(75) Inventor: William Frank Dunn, Austin, TX (US)

(73) Assignee: Etymotic Research, Inc., Elk Grove Village, IL (US)

( * ) Notice: Subject to any disclaimer, the term of this patent is extended or adjusted under 35 U.S.C. 154(b) by 450 days.

(21) Appl. No.: 13/463,556

(22) Filed: May 3, 2012

(65) Prior Publication Data

US 2012/0281853 A1 Nov. 8, 2012

Related U.S. Application Data

(60) Provisional application No. 61/483,123, filed on May 6, 2011.

(51) Int. Cl.
*H04R 3/00* (2006.01)

(52) U.S. Cl.
CPC ..... *H04R 3/005* (2013.01)

(58) Field of Classification Search
CPC ..... H04R 3/00; H04R 1/02
USPC ..... 381/91–92, 122, 123
See application file for complete search history.

(56) References Cited

U.S. PATENT DOCUMENTS

| | | | | |
|---|---|---|---|---|
| 5,940,521 | A * | 8/1999 | East et al. | 381/119 |
| 6,333,984 | B1 * | 12/2001 | Yang | 381/364 |
| 6,882,335 | B2 * | 4/2005 | Saarinen | 345/156 |
| 7,912,237 | B2 * | 3/2011 | Fischer | 381/315 |
| 8,174,547 | B2 * | 5/2012 | Yoneda et al. | 345/177 |
| 8,189,818 | B2 * | 5/2012 | Takahashi et al. | 381/122 |
| 2001/0011993 | A1 * | 8/2001 | Saarinen | 345/156 |
| 2005/0069149 | A1 * | 3/2005 | Takahashi et al. | 381/91 |
| 2006/0233406 | A1 * | 10/2006 | Fischer | 381/313 |
| 2010/0232618 | A1 * | 9/2010 | Haartsen et al. | 381/80 |
| 2011/0182436 | A1 * | 7/2011 | Murgia et al. | 381/71.1 |
| 2011/0280409 | A1 * | 11/2011 | Michael et al. | 381/60 |
| 2012/0087510 | A1 * | 4/2012 | Sampimon et al. | 381/74 |
| 2013/0177168 | A1 * | 7/2013 | Inha et al. | 381/92 |

* cited by examiner

*Primary Examiner* — Disler Paul
(74) *Attorney, Agent, or Firm* — McAndrews, Held & Malloy, Ltd.

(57) ABSTRACT

Systems and methods for enhancing speech intelligibility using a companion microphone system can include microphones, a position sensor and a microcontroller. In certain embodiments, the position sensor is configured to generate position data corresponding to a position of the companion microphone system. In various embodiments, the microphones and the position sensor include a fixed relationship in three-dimensional space. In certain embodiments, the microcontroller is configured to receive the position data from the position sensor and select one or more of the microphones to receive an audio input based on the received position data.

27 Claims, 14 Drawing Sheets

SYSTEM AND METHOD FOR ENHANCING SPEECH INTELLIGIBILITY USING COMPANION MICROPHONES WITH POSITION SENSORS

CROSS-REFERENCE TO RELATED APPLICATIONS/INCORPORATION BY REFERENCE

This patent application makes reference to, claims priority to and claim benefit from U.S. Provisional Patent Application Ser. No. 61/483,123, entitled "System and Method for Enhancing Speech Intelligibility using Companion Microphones with Position Sensors," filed on May 6, 2011, the complete subject matter of which is hereby incorporated herein by reference, in its entirety.

U.S. Pat. No. 5,966,639 issued to Goldberg et al. on Oct. 12, 1999, is incorporated by reference herein in its entirety.

U.S. Pat. No. 8,019,386 issued to Dunn on Sep. 13, 2011, is incorporated by reference herein in its entirety.

U.S. Pat. No. 8,150,057 issued to Dunn on Apr. 3, 2012, is incorporated by reference herein in its entirety.

FEDERALLY SPONSORED RESEARCH OR DEVELOPMENT

This invention was made with government support under grant number 4R44DC010971-02 awarded by the National Institutes of Health (NIH). The Government has certain rights in the invention.

MICROFICHE/COPYRIGHT REFERENCE

[Not Applicable]

BACKGROUND OF THE INVENTION

Certain embodiments provide a system and method for enhancing speech intelligibility using companion microphones with position sensors. More specifically, certain embodiments provide a companion microphone unit that adapts the microphone configuration of the companion microphone unit to the detected position of the companion microphone unit.

The quality of life of an individual depends to a great extent on the ability to communicate with others. When the ability to communicate is compromised, there is a tendency to withdraw. Companion microphone systems were developed to help those who have significant difficulty understanding conversation in background noise, such as encountered in restaurants and other noisy places. With companion microphone systems, individuals that have been excluded from conversation in noisy places can enjoy social situations and fully participate again.

Methods and systems for enhancing speech intelligibility using wireless communication in portable, battery-powered and entirely user-supportable devices are described, for example, in U.S. Pat. No. 5,966,639 issued to Goldberg et al. on Oct. 12, 1999; U.S. Pat. No. 8,019,386 issued to Dunn on Sep. 13, 2011; and, U.S. Pat. No. 8,150,057 issued to Dunn on Apr. 3, 2012.

Existing companion microphone units are typically worn using a lanyard or other similar attachment. Although the lanyard provides a known orientation for the microphone of the device, the lanyard and other similar attachments have not been well received. For example, some wearers of companion microphone systems on lanyards have found the lanyards to be uncomfortable.

As such, there is a need for a more comfortable "clip it anywhere" companion microphone unit that adapts the microphone configuration of the companion microphone unit to the detected position of the companion microphone unit.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Certain embodiments provide a system and method for enhancing speech intelligibility using companion microphones with position sensors, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION

Figure 1:
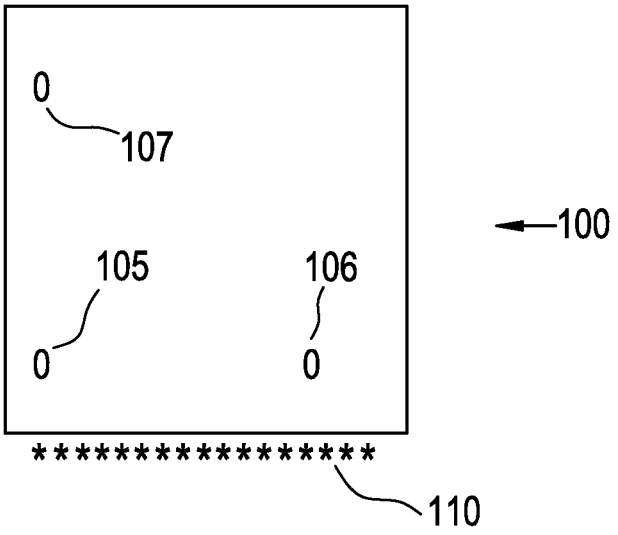
FIG. 1 illustrates an exemplary companion microphone unit, in accordance with an embodiment of the present technology.

Certain embodiments provide a system and method for enhancing speech intelligibility using companion microphones 100 with position sensors 104. The present technology provides a companion microphone unit 100 that adapts the microphone configuration of the companion microphone unit 100 to a detected position of the companion microphone unit 100.

Various embodiments provide a companion microphone system 100 comprising a plurality of microphones 105-107, a position sensor 104 and a microcontroller 101. The position sensor 104 is configured to generate position data corresponding to a position of the companion microphone system 100. The plurality of microphones 105-107 and the position sensor 104 comprise a fixed relationship in three-dimensional space. The microcontroller 101 is configured to receive the position data from the position sensor 104 and select at least one of the plurality of microphones 105-107 to receive an audio input based on the received position data.

Certain embodiments provide a method 200 for adapting a microphone configuration of a companion microphone system 100. The method comprises polling 201 a position sensor 104 for position data corresponding to a position of the companion microphone system 100. The method also comprises determining 202 the position of the companion microphone system 100 based on the position data. Further, the method comprises selecting 204 at least one microphone of a plurality of microphones 105-107 based on the position data. The method further comprises receiving 206 an audio input from the selected at least one microphone of the plurality of microphones 105-107.

Various embodiments provide a non-transitory computer-readable medium encoded with a set of instructions for execution on a computer. The set of instructions comprises a polling routine configured to poll 201 a position sensor 104 for position data corresponding to a position of a companion microphone system 100. The set of instructions also comprises a position determination routine configured to determine 202 the position of the companion microphone system 100 based on the position data. The set of instructions further comprises a microphone selection routine configured to select 204 at least one microphone of a plurality of microphones 105-107 based on the position data. Further, the set of instructions comprises an audio input receiving routine configured to receive 206 an audio input from the selected at least one microphone of the plurality of microphones 105-107.

FIG. 1 illustrates an exemplary companion microphone unit 100, in accordance with an embodiment of the present technology. The companion microphone unit 100 comprises microphones 105-107 and an attachment mechanism 110 for detachably coupling to a user of the companion microphone unit 100. In various embodiments, the spacing between microphones 105 and 107 may be substantially the same as the spacing between microphones 105 and 106, for example. The attachment mechanism 110 may be a clip, or any other suitable attachment mechanism, for attaching to a user's clothing or the like. For example, the companion microphone unit 100 may be conveniently clipped near the mouth of a talker on clothing or the like. The attachment mechanism 110 may be on an opposite surface of the companion microphone 100 from the inlets of the microphones 105-107 such that the inlets of microphones 105-107 are not obstructed when the companion microphone unit 100 is attached to a user's clothing or the like.

Figure 2:
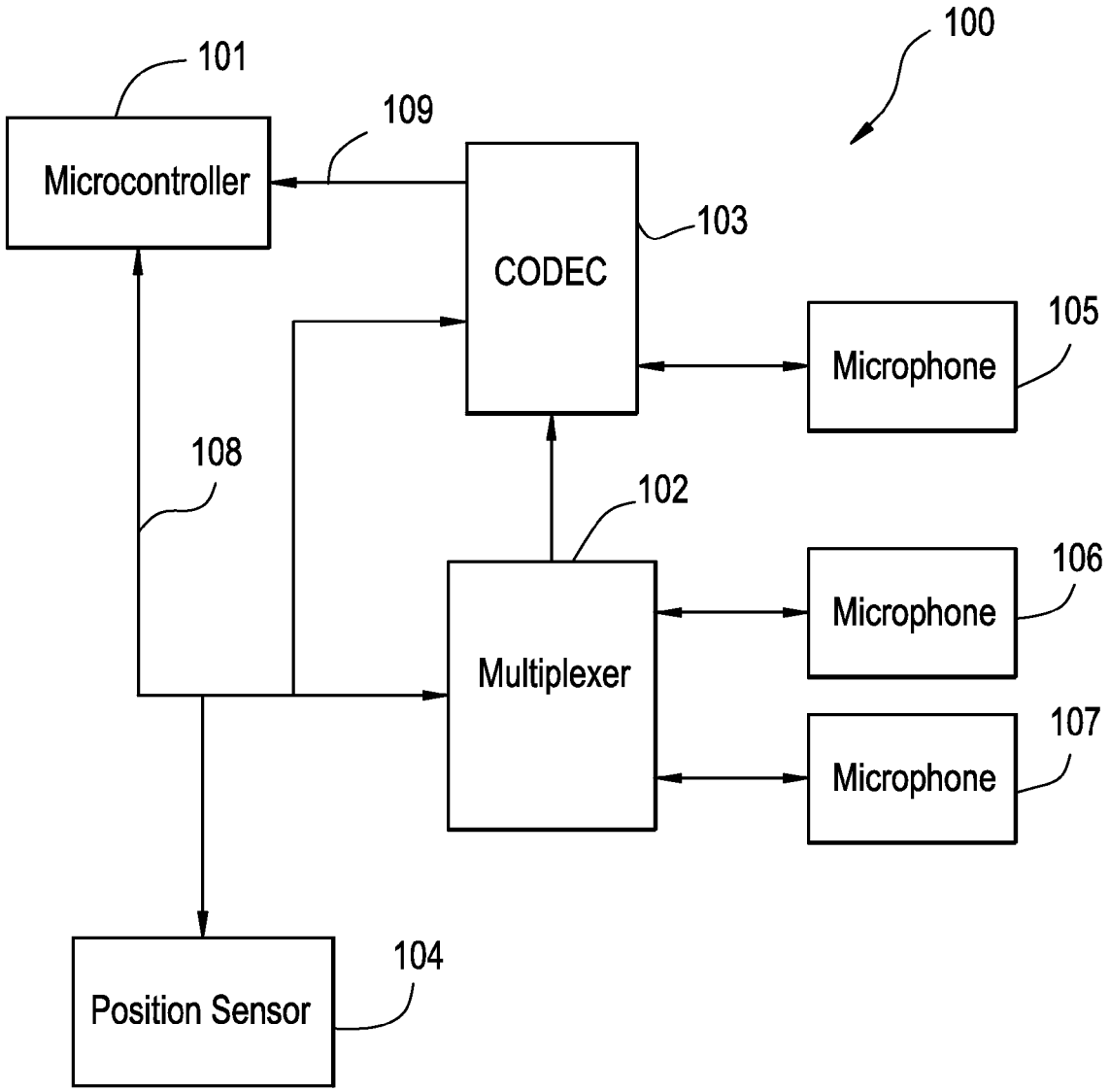
FIG. 2 illustrates a block diagram depicting an exemplary companion microphone unit, in accordance with an embodiment of the present technology.

FIG. 2 illustrates a block diagram depicting an exemplary companion microphone unit 100, in accordance with an embodiment of the present technology. The companion microphone unit 100 comprises a microcontroller 101, a multiplexer, a coder/decoder (CODEC) 103, a position sensor 104, and microphones 105-107. In certain embodiments, one or more of the companion microphone unit components are integrated into a single unit, or may be integrated in various forms. As an example, multiplexer 102 and CODEC 103 may be integrated into a single unit, among other things.

In various embodiments, the companion microphone unit 100 may comprise one or more buses 108-109. For example, the microcontroller 101 may use one or more control buses 108 to configure the CODEC 103 to provide audio samples from microphones 105-107 over the bus(es) 109. In an embodiment, the microcontroller 101 may poll the position sensor 104 using one or more control buses 108 and the position sensor 104 may transmit position data to microcontroller 101 using the bus(es) 108. As another example, the microcontroller 101 may use one or more control buses 108 to select which of the microphones 106-107 to use for the CODEC 103 by the multiplexer 102. The bus 109 may be an Integrated Interchip Sound (I2S) bus, or any suitable bus. The control bus 108 may be Serial Peripheral Interface (SPI) buses, Inter Integrated Circuit (I2C) buses, or any suitable bus. Referring to FIG. 2, control bus 108 between microcontroller 101 and multiplexer 102, CODEC 103 and position sensor 104, may be separate buses, combined buses or a combination thereof.

In certain embodiments, microphones 105-107 and the position sensor 104 have a fixed relationship in three-dimensional (3D) space. For example, microphones 105-107 can be mounted on the same printed circuit board, among other things. The microphones 105-107 are configured to receive audio signals. The microphones 105-107 can be omni-directional microphones, for example. The microphones 105-107 may be microelectomechanical systems (MEMS) microphones, electret microphones or any other suitable microphone. In certain embodiments, gain adjustment information for each of the microphones 105-107 may be stored in memory (not shown) for use by microcontroller 101. In various embodiments, the spacing between microphones 105 and 107 may be substantially the same as the spacing between microphones 105 and 106, for example. The position sensor 104 generates position data corresponding to a position of the companion microphone unit. The position sensor 104 can be a 3D sensor or any other suitable position sensor. For example, the position sensor 104 may be a Freescale Semiconductor MMA7660 position sensor, among other things.

Figure 3:
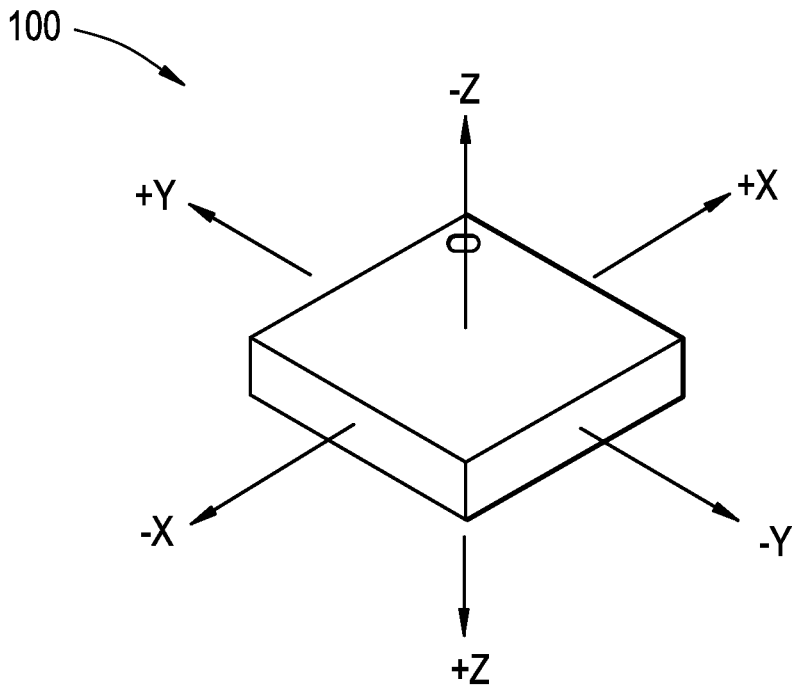
FIG. 3 illustrates a perspective view of an exemplary companion microphone unit, in accordance with an embodiment of the present technology.

The companion microphone unit 100 uses one or more position sensors 104 to control the microphone polar pattern. The microcontroller 101 polls the position sensor 104 using control bus 108. In various embodiments, poll times may be in an order of magnitude of approximately one second (i.e., 0.5-2.0 seconds), for example, because the relative position of the companion microphone unit 100 is not likely to readily change over time. FIG. 3 illustrates a perspective view of an exemplary companion microphone unit in three-dimensional space, in accordance with an embodiment of the present technology. Referring to FIGS. 2-3, the microcontroller 101 receives position data from position sensor 104 to determine the current position of the companion microphone unit 100 in three-dimensional space.

The determined current position (e.g., XYZ coordinates in three dimensional space) of the companion microphone unit 100, based on the position data output from the one or more position sensors 104 to the microcontroller 101, may be used by the microcontroller 101 to choose which one or pair of microphones to enable, out of, for example, three omni-directional microphones 105-107 of the companion microphone unit 100. For example, the position data may be used to correlate a three-dimensional (XYZ) orientation to a likely position of a user's mouth. The likely position of a user's mouth may be a predetermined estimated position in relation to a position of the companion microphone unit 100, for example. Based on the three-dimensional (XYZ) orientation to the likely position of the user's mouth, the microcontroller 101 may select, for example, one of the following combinations of microphones in a specified order for a directional mode:

a) from microphone 105 (front/primary port) to microphone 106 (rear/cancellation port), b) from microphone 105 (front/primary port) to microphone 107 (rear/cancellation port), c) from microphone 106 (front/primary port) to microphone 105 (rear/cancellation port), or d) from microphone 107 (front/primary port) to microphone 105 (rear/cancellation port).

In certain embodiments, an omni mode may be used when the microcontroller 101 determines that there is not a clear position advantage for using one of the above-mentioned directional mode microphone combinations. For example, the omni mode may be used when the position data indicates that the likely position of a user's mouth is halfway between two of the microphone 105-107 axis. In omni mode, one of microphones 105-107 may be selected by microcontroller 101, for example. Additionally and/or alternatively, in omni mode, a plurality of microphones 105-107 may be selected and the audio inputs from the plurality of selected microphones are averaged, for example.

In various embodiments, the microcontroller 101 may change selected microphone combinations and/or modes when the microcontroller 101 detects, based on the position data received from position sensor(s) 104, a change in three-dimensional orientation of the companion microphone unit 100 that corresponds with a different microphone combination and/or mode (i.e., a substantial change), and when the detected change in three-dimensional orientation is stable over a predetermined number of polling periods. For example, if the predetermined number of polling periods is two polling periods, the microcontroller may select a different microphone combination and/or mode when the microcontroller 101 receives position data from position sensor(s) 104 over two polling periods indicating that the orientation of the companion microphone unit 100 has changed such that the selected microphone combination and/or mode should also change.

In various embodiments, the microcontroller 101 may use control bus 108 to select, using multiplexer 102, which, if any, of microphones 106-107 to use with microphone 105. For example, two audio channels may be available. Certain embodiments provide that microphones 105-107 are connected to multiplexer 102 and the microcontroller 101 may use control bus 108 to select, using multiplexer 102, which of microphones 105-107 to enable for use. In certain embodiments, audio samples from the three microphones 105-107 may be provided to the microcontroller 101 over the bus 109 and the microcontroller may select the microphone(s) by determining which one or more audio samples to use, for example.

In certain embodiments, the microcontroller 101 uses control bus 108 to configure the CODEC 103 to provide audio samples over bus 109. The microcontroller 101 may be a ST Microelectronics STM32F103 or any suitable microcontroller, for example. The CODEC 103 can be a Wolfson WM8988, or any suitable CODEC for converting analog signals received from microphones 105-107 to digital audio samples for use by microcontroller 101. In certain embodiments, the multiplexer 102 can be separate or integrated into the CODEC 103.

Certain embodiments provide that the microcontroller 101 uses the audio samples from the one or more selected microphones 105-107 to process and provide a processed digital audio signal. For example, the microprocessor 101 may determine, based on the position data from position sensor(s) 104, to use the CODEC digital audio samples from microphone 105, 106 or 107 in omni mode. As another example, the microprocessor 101 may subtract two audio samples from the selected microphones. Additionally and/or alternatively, the microprocessor 101 may apply a time delay to implement cardioid or other directional microphone methods.

In certain embodiments, if a cardiod pattern is desired, the rear/cancellation port microphone may be subjected to a time delay appropriate to the spacing between the selected microphone combination. For example, if a cardiod pattern is desired and the selected microphones' inlets are spaced 8 mm apart, a 24 uS time delay may be applied between the output of the rear/cancellation microphone and a summing (subtracting) junction. In various embodiments, if a figure 8 pattern is desired in order to minimize echo pickup from neighboring microphones in certain applications, then no time delay may be applied. Rather, there may be a null perpendicular to the line between the microphone inlets.

Figure 4A:
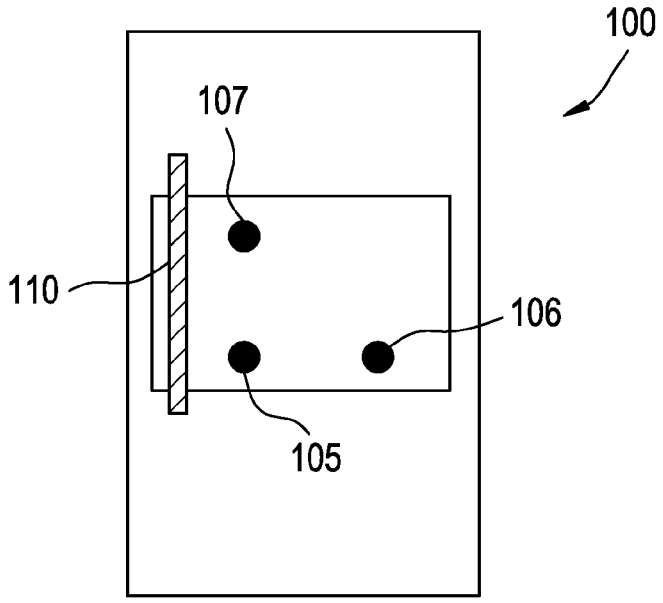
FIG. 4A illustrates an exemplary companion microphone unit, in accordance with an embodiment of the present technology.
Figure 4B:
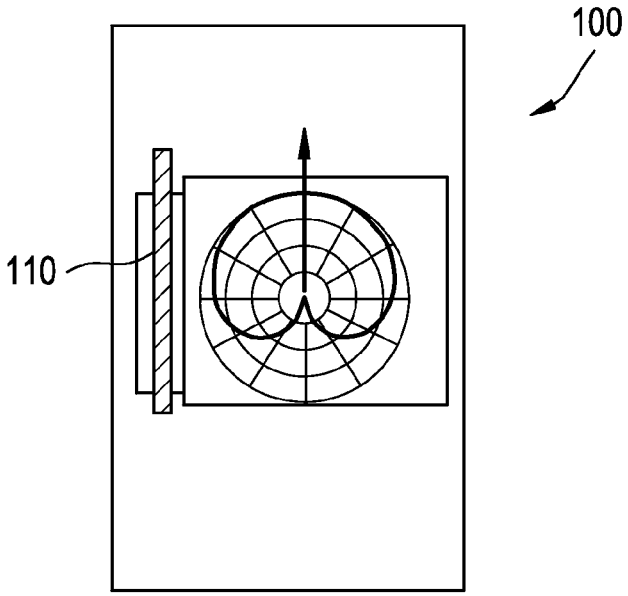
FIG. 4B illustrates the exemplary companion microphone unit of FIG. 4A with a polar plot superimposed in an exemplary microphone default orientation aimed along a long dimension of the companion microphone unit, in accordance with an embodiment of the present technology.

FIG. 4A illustrates an exemplary companion microphone unit 100, in accordance with an embodiment of the present technology. The companion microphone unit 100 comprises microphones 105-107 and an attachment mechanism 110 for detachably coupling to a user of the companion microphone unit 100. The attachment mechanism 110 may be on an opposite surface of the companion microphone 100 from the inlets of the microphones 105-107 such that the inlets of microphones 105-107 are not obstructed when the companion microphone unit 100 is attached to a user's clothing or the like. FIG. 4B illustrates the exemplary companion microphone unit of FIG. 4A with a polar plot superimposed in an exemplary microphone default orientation aimed along a long dimension of the companion microphone unit, in accordance with an embodiment of the present technology. For example, the microphone default orientation corresponding to FIGS. 4A-4B is from microphone 107 (front/primary port) to microphone 105 (rear/cancellation port).

Figure 5A:
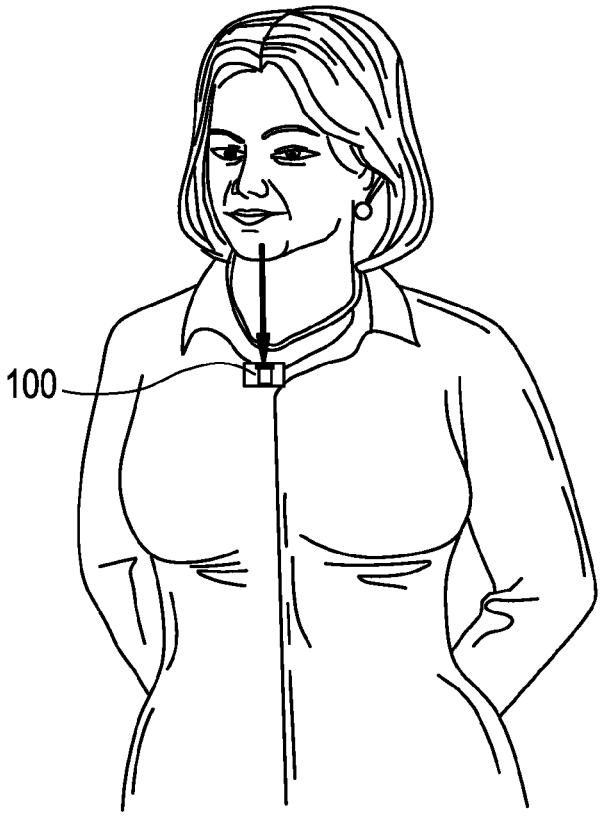
FIG. 5A illustrates an exemplary companion microphone unit attached to a user's clothing, in accordance with an embodiment of the present technology.
Figure 5B:
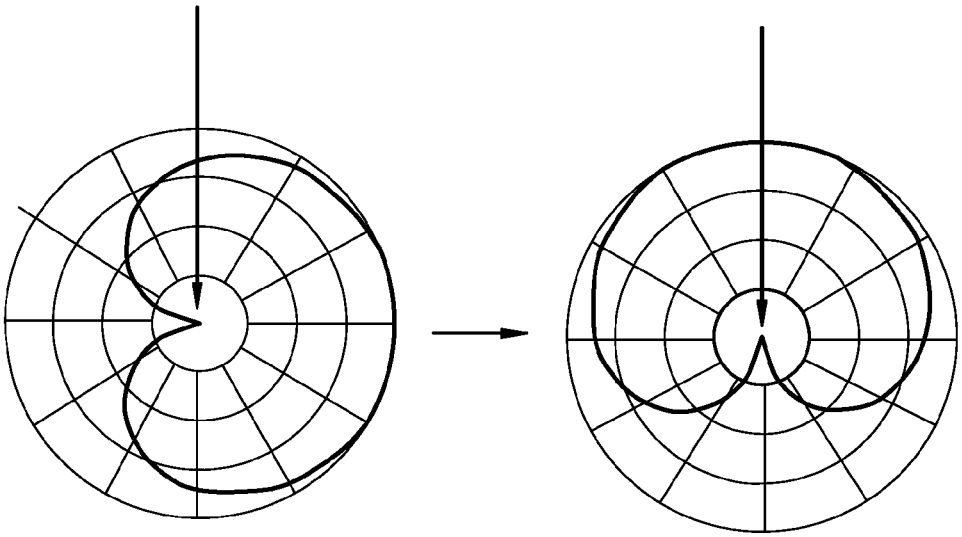
FIG. 5B illustrates an exemplary polar plot change from a default orientation corresponding to FIGS. 4A-4B to a selected orientation corresponding to a microphone selection based on a detected position of the companion microphone unit of FIG. 5A, in accordance with an embodiment of the present technology.

FIG. 5A illustrates an exemplary companion microphone unit 100 attached to a user's clothing, in accordance with an embodiment of the present technology. FIG. 5B illustrates an exemplary polar plot change from a default orientation corresponding to FIGS. 4A-4B to a selected orientation corresponding to a microphone selection based on a detected position of the companion microphone unit 100 of FIG. 5A, in accordance with an embodiment of the present technology. For example, the polar plots of FIG. 5B illustrate the −90° rotation corresponding with the microphone combination selection changing from the default orientation of FIGS. 4A-4B (from microphone 107 to microphone 105) to a selected microphone combination from microphone 105 to microphone 106.

Figure 6A:
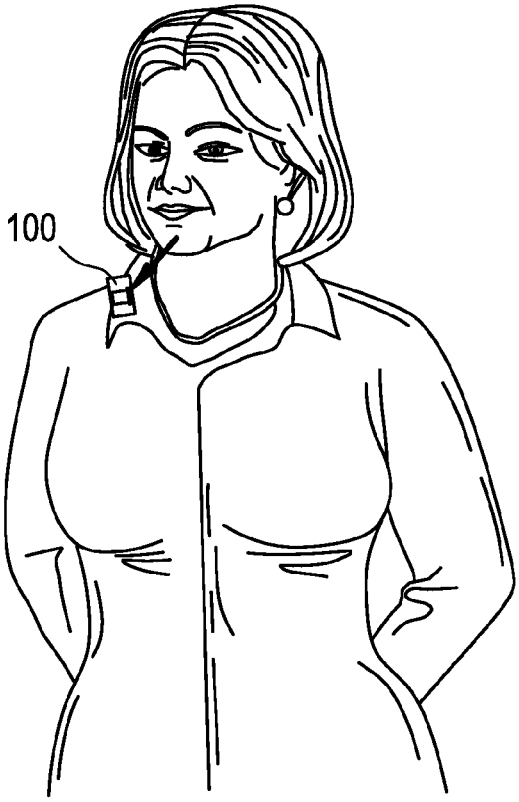
FIG. 6A illustrates an exemplary companion microphone unit attached to a user's clothing, in accordance with an embodiment of the present technology.
Figure 6B:
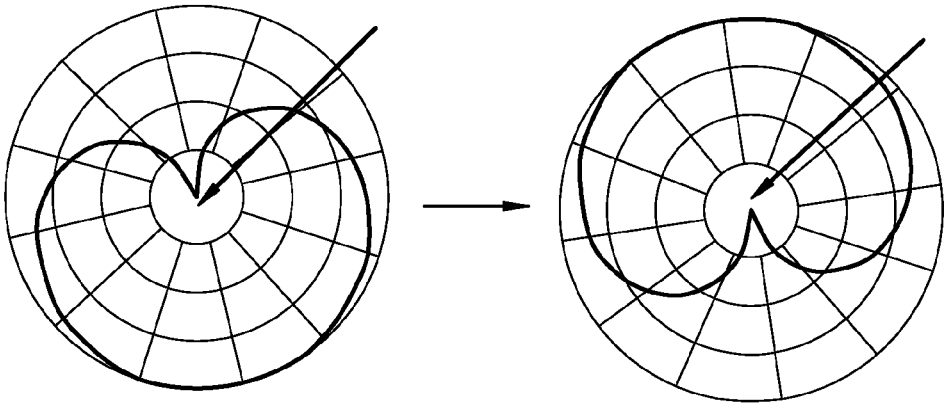
FIG. 6B illustrates an exemplary polar plot change from a default orientation corresponding to FIGS. 4A-4B to a selected orientation corresponding to a microphone selection based on a detected position of the companion microphone unit of FIG. 6A, in accordance with an embodiment of the present technology.

FIG. 6A illustrates an exemplary companion microphone unit 100 attached to a user's clothing, in accordance with an embodiment of the present technology. FIG. 6B illustrates an exemplary polar plot change from a default orientation corresponding to FIGS. 4A-4B to a selected orientation corresponding to a microphone selection based on a detected position of the companion microphone unit 100 of FIG. 6A, in accordance with an embodiment of the present technology. For example, the polar plots of FIG. 6B illustrate the 180° rotation corresponding with the microphone combination selection changing from the default orientation of FIGS. 4A-4B (from microphone 107 to microphone 105) to a selected microphone combination from microphone 105 to microphone 107.

Figure 7A:
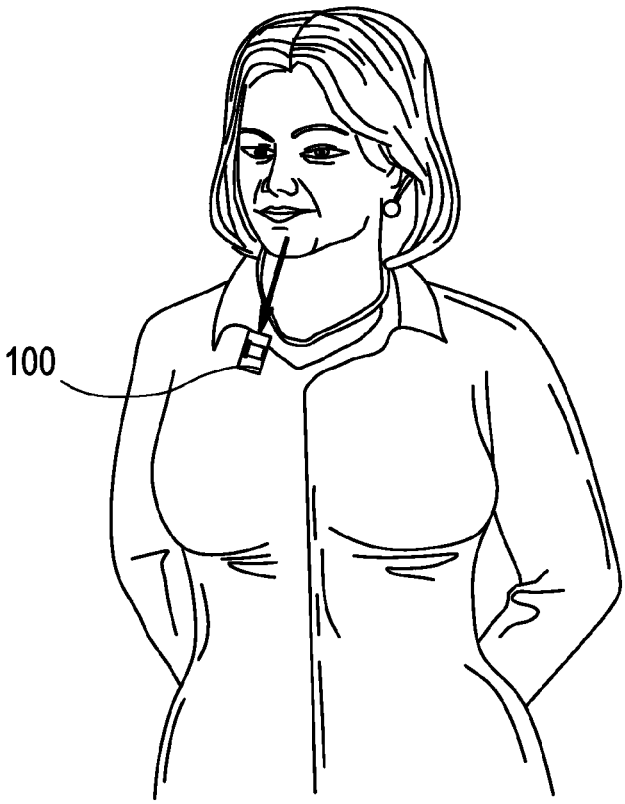
FIG. 7A illustrates an exemplary companion microphone unit attached to a user's clothing, in accordance with an embodiment of the present technology.
Figure 7B:
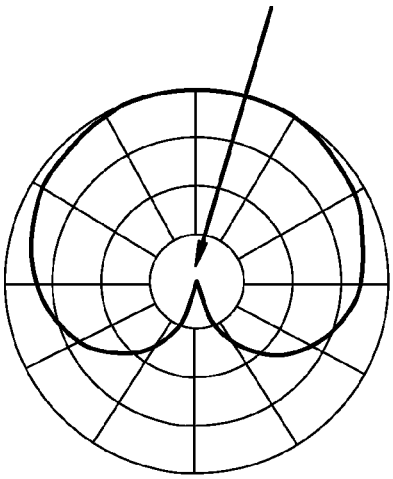
FIG. 7B illustrates an exemplary polar plot for the companion microphone unit of FIG. 7A, in accordance with an embodiment of the present technology.

FIG. 7A illustrates an exemplary companion microphone unit 100 attached to a user's clothing, in accordance with an embodiment of the present technology. FIG. 7B illustrates an exemplary polar plot for the companion microphone unit 100 of FIG. 7A, in accordance with an embodiment of the present technology. For example, the polar plot of FIG. 7B illustrates that the default orientation corresponding to FIGS. 4A-4B represents the optimal microphone combination selection given the detected position of the companion microphone unit of FIG. 7A.

Figure 8A:
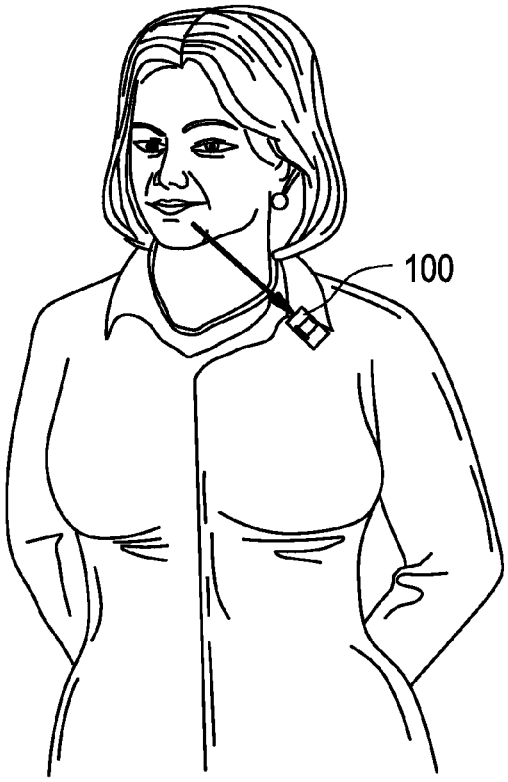
FIG. 8A illustrates an exemplary companion microphone unit attached to a user's clothing, in accordance with an embodiment of the present technology.
Figure 8B:
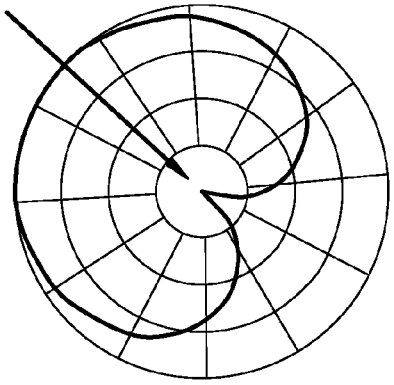
FIG. 8B illustrates an exemplary polar plot for the companion microphone unit of FIG. 8A, in accordance with an embodiment of the present technology.

FIG. 8A illustrates an exemplary companion microphone unit 100 attached to a user's clothing, in accordance with an embodiment of the present technology. FIG. 8B illustrates an exemplary polar plot for the companion microphone unit 100 of FIG. 8A, in accordance with an embodiment of the present technology. For example, the polar plot of FIG. 8B illustrates that the default orientation corresponding to FIGS. 4A-4B represents the optimal microphone combination selection given the detected position of the companion microphone unit of FIG. 8A.

Figure 9A:
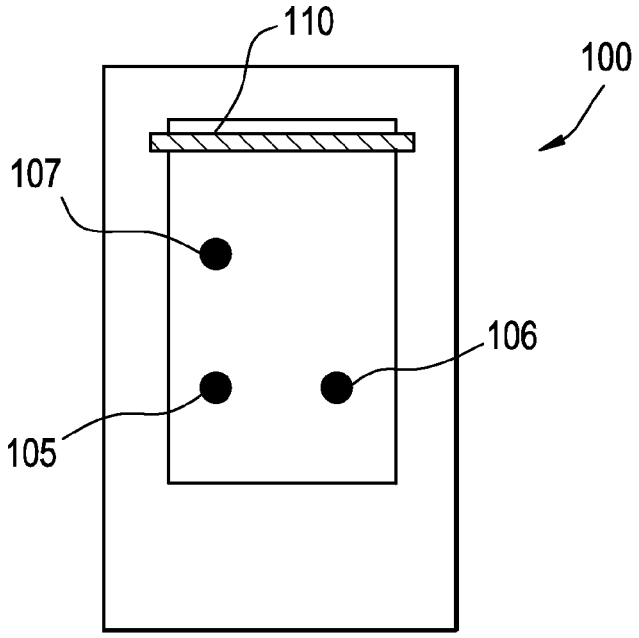
FIG. 9A illustrates exemplary companion microphone unit, in accordance with an embodiment of the present technology.
Figure 9B:
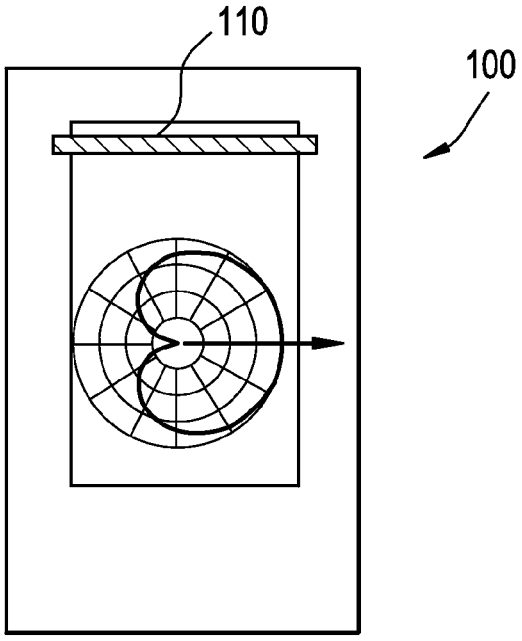
FIG. 9B illustrates the exemplary companion microphone unit of FIG. 9A with a polar plot superimposed in an exemplary microphone default orientation aimed along a short dimension of the companion microphone unit, in accordance with an embodiment of the present technology.

FIG. 9A illustrates an exemplary companion microphone unit 100, in accordance with an embodiment of the present technology. The companion microphone unit 100 comprises microphones 105-107 and an attachment mechanism 110 for detachably coupling to a user of the companion microphone unit 100. The attachment mechanism 110 may be on an opposite surface of the companion microphone 100 from the inlets of the microphones 105-107 such that the inlets of microphones 105-107 are not obstructed when the companion microphone unit 100 is attached to a user's clothing or the like. FIG. 9B illustrates the exemplary companion microphone unit of FIG. 9A with a polar plot superimposed in an exemplary microphone default orientation aimed along a short dimension of the companion microphone unit, in accordance with an embodiment of the present technology. For example, the microphone default orientation corresponding to FIGS. 9A-9B is from microphone 106 (front/primary port) to microphone 105 (rear/cancellation port).

Figure 10A:
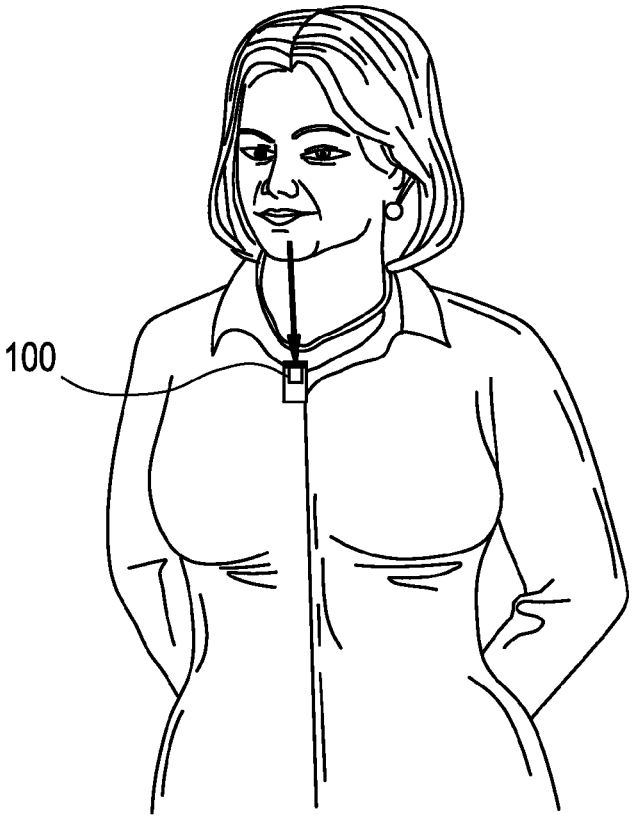
FIG. 10A illustrates an exemplary companion microphone unit attached to a user's clothing, in accordance with an embodiment of the present technology.
Figure 10B:
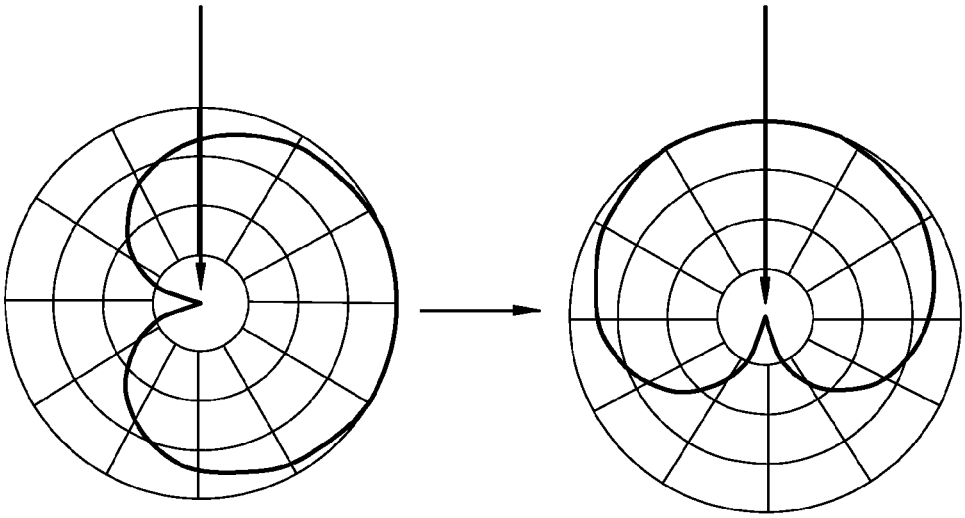
FIG. 10B illustrates an exemplary polar plot change from a default orientation corresponding to FIGS. 9A-9B to a selected orientation corresponding to a microphone selection based on a detected position of the companion microphone unit of FIG. 10A, in accordance with an embodiment of the present technology.

FIG. 10A illustrates an exemplary companion microphone unit 100 attached to a user's clothing, in accordance with an embodiment of the present technology. FIG. 10B illustrates an exemplary polar plot change from a default orientation corresponding to FIGS. 9A-9B to a selected orientation corresponding to a microphone selection based on a detected position of the companion microphone unit 100 of FIG. 10A, in accordance with an embodiment of the present technology. For example, the polar plots of FIG. 10B illustrate the −90° rotation corresponding with the microphone combination selection changing from the default orientation of FIGS. 9A-9B (from microphone 106 to microphone 105) to a selected microphone combination from microphone 107 to microphone 105.

Figure 11A:
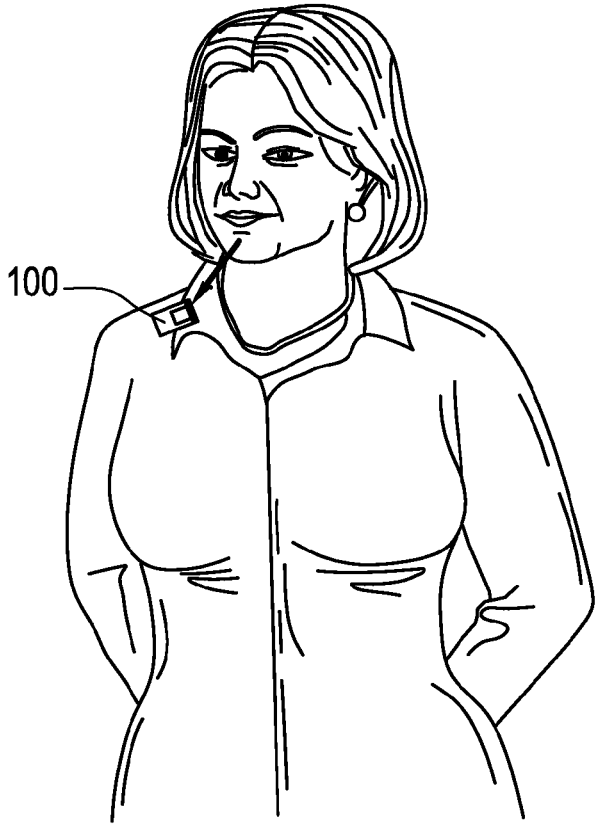
FIG. 11A illustrates an exemplary companion microphone unit attached to a user's clothing, in accordance with an embodiment of the present technology.
Figure 11B:
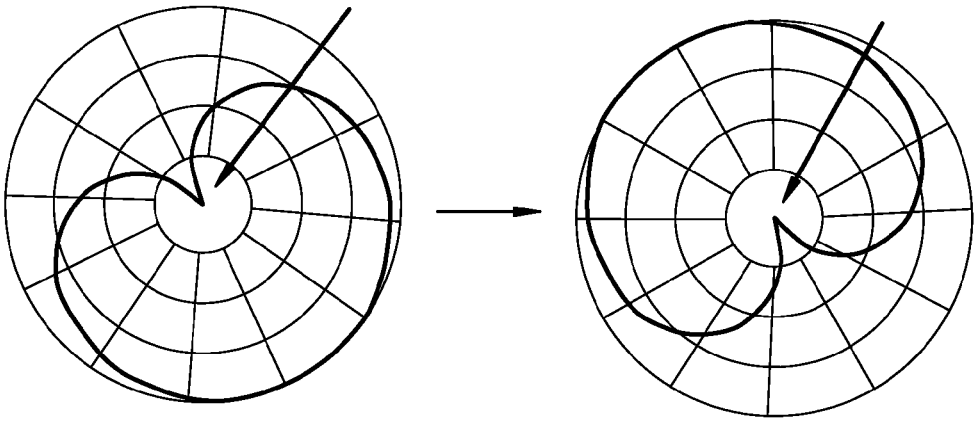
FIG. 11B illustrates an exemplary polar plot change from a default orientation corresponding to FIGS. 9A-9B to a selected orientation corresponding to a microphone selection based on a detected position of the companion microphone unit of FIG. 11A, in accordance with an embodiment of the present technology.

FIG. 11A illustrates an exemplary companion microphone unit 100 attached to a user's clothing, in accordance with an embodiment of the present technology. FIG. 11B illustrates an exemplary polar plot change from a default orientation corresponding to FIGS. 9A-9B to a selected orientation corresponding to a microphone selection based on a detected position of the companion microphone unit 100 of FIG. 11A, in accordance with an embodiment of the present technology. For example, the polar plots of FIG. 11B illustrate the 180° rotation corresponding with the microphone combination selection changing from the default orientation of FIGS. 9A-9B (from microphone 106 to microphone 105) to a selected microphone combination from microphone 105 to microphone 106.

Figure 12A:
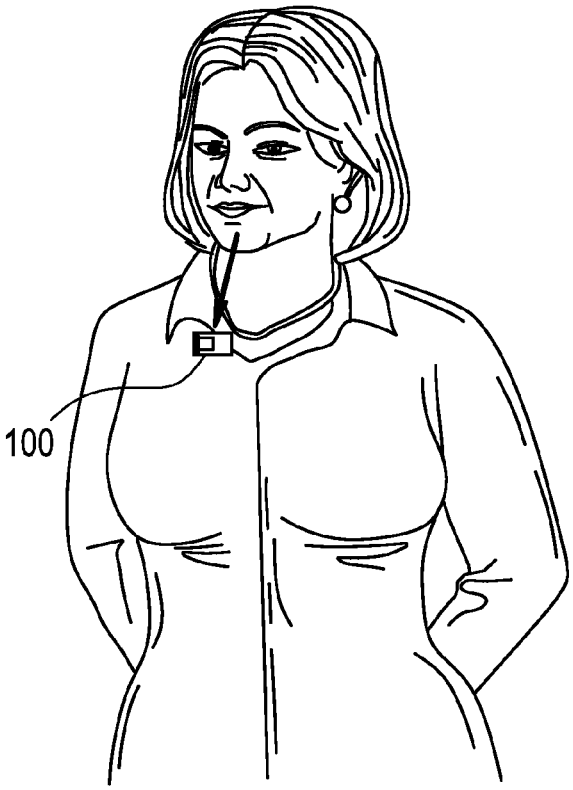
FIG. 12A illustrates an exemplary companion microphone unit attached to a user's clothing, in accordance with an embodiment of the present technology.
Figure 12B:
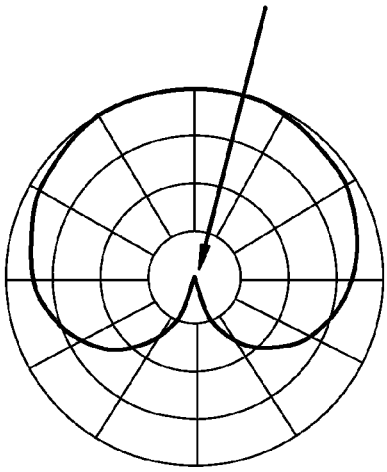
FIG. 12B illustrates an exemplary polar plot for the companion microphone unit of FIG. 12A, in accordance with an embodiment of the present technology.

FIG. 12A illustrates an exemplary companion microphone unit 100 attached to a user's clothing, in accordance with an embodiment of the present technology. FIG. 12B illustrates an exemplary polar plot for the companion microphone unit 100 of FIG. 12A, in accordance with an embodiment of the present technology. For example, the polar plot of FIG. 12B illustrates that the default orientation corresponding to FIGS.

9A-9B represents the optimal microphone combination selection given the detected position of the companion microphone unit of FIG. 12A.

Figure 13A:
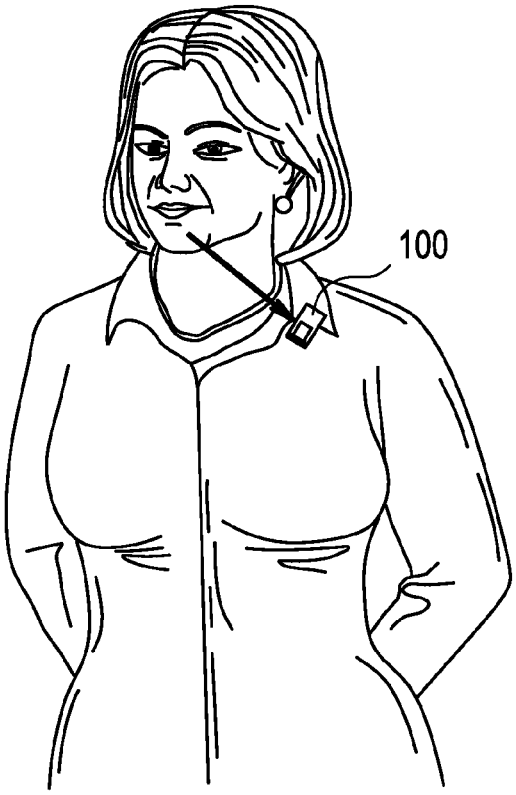
FIG. 13A illustrates an exemplary companion microphone unit attached to a user's clothing, in accordance with an embodiment of the present technology.
Figure 13B:
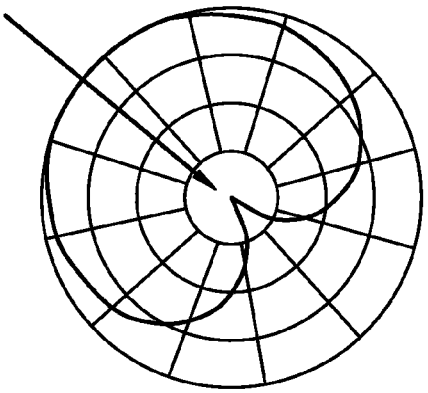
FIG. 13B illustrates an exemplary polar plot for the companion microphone unit of FIG. 13A, in accordance with an embodiment of the present technology.

FIG. 13A illustrates an exemplary companion microphone unit 100 attached to a user's clothing, in accordance with an embodiment of the present technology. FIG. 13B illustrates an exemplary polar plot for the companion microphone unit 100 of FIG. 13A, in accordance with an embodiment of the present technology. For example, the polar plot of FIG. 13B illustrates that the default orientation corresponding to FIGS. 9A-9B represents the optimal microphone combination selection given the detected position of the companion microphone unit of FIG. 13A.

Figure 14:
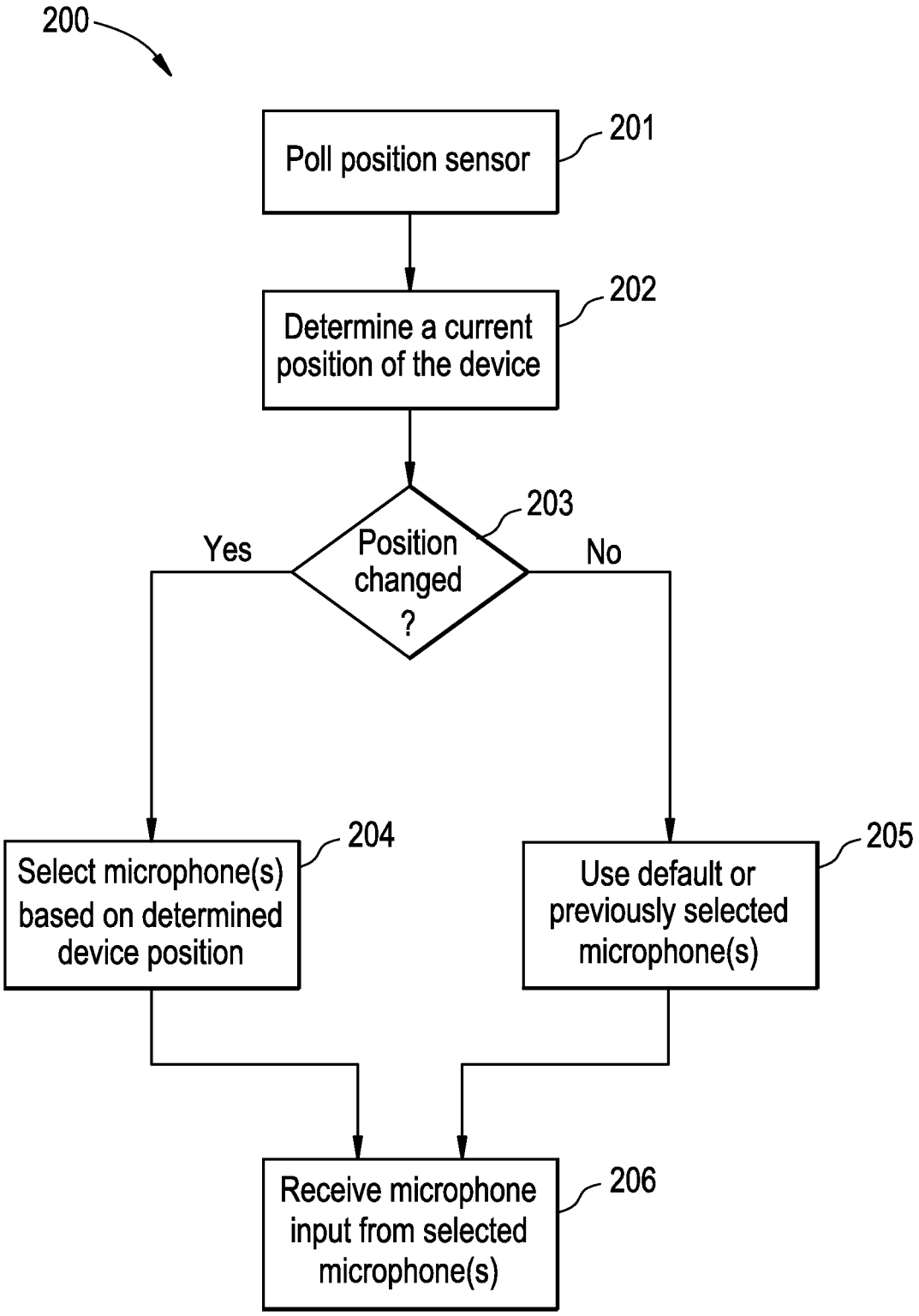
FIG. 14 illustrates a flow diagram of an exemplary method for adapting a microphone configuration of a companion microphone unit to a detected position of the companion microphone unit, in accordance with an embodiment of the present technology.

FIG. 14 illustrates a flow diagram of an exemplary method 200 for adapting a microphone configuration of a companion microphone unit 100 to a detected position of the companion microphone unit 100, in accordance with an embodiment of the present technology.

At 201, one or more position sensors are polled. In certain embodiments, for example, the microcontroller 101 may poll the position sensor(s) 104 using one or more control buses 108 and the position sensor(s) 104 may transmit position data to microcontroller 101 using the bus(es) 108.

At 202, a current position of the companion microphone unit 100 is determined. In certain embodiments, for example, the microcontroller 101 may determine XYZ coordinates in three-dimensional space of the companion microphone unit 100, based on the position data output from the one or more position sensors 104 to the microcontroller 101.

At 203, the microcontroller 101 determines whether the position of the companion microphone unit 100 has changed. In certain embodiments, for example, the microcontroller 101 may determine whether the XYZ coordinates in three-dimensional space of the companion microphone unit 100 have changed from a previous or default position such that a different one or combination of microphones would provide better performance than the current microphone or combination of microphones (e.g., the default or previously-selected microphone(s)).

In various embodiments, poll times may be in an order of magnitude of approximately one second, or any suitable interval. As such, steps 201-203 may repeat at the predetermined poll time interval.

At step 204, if the companion microphone unit 100 position has changed such that a different one or combination of microphones would provide better performance than the current microphone or combination of microphones (e.g., the default or previously-selected microphone(s)), as indicated by step 203, the microcontroller 101 may change selected microphone combinations and/or modes. For example, as discussed above with regard to FIGS. 5-6 and 10-11, the microphone combination selection may change from a default (or otherwise previously selected) orientation of to a new selected microphone or microphone combination, to achieve improved performance over the default (or otherwise previously selected) microphone(s).

As an example, the position data may be used to correlate a three-dimensional (XYZ) orientation to a likely position of a user's mouth. Based on the three-dimensional (XYZ) orientation to the likely position of the user's mouth, the microcontroller 101 may select, for example, one of the following combinations of microphones in a specified order for a directional mode:

a) from microphone 105 (front/primary port) to microphone 106 (rear/cancellation port), b) from microphone 105 (front/primary port) to microphone 107 (rear/cancellation port), c) from microphone 106 (front/primary port) to microphone 105 (rear/cancellation port), or d) from microphone 107 (front/primary port) to microphone 105 (rear/cancellation port).

In certain embodiments, an omni mode may be used when the microcontroller 101 determines that there is not a clear position advantage for using one of the above-mentioned directional mode microphone combinations. For example, the omni mode may be used when the position data indicates that the user's mouth is halfway between two of the microphone 105-107 axis. In omni mode, one of microphones 105-107 is selected by microcontroller 101, for example.

In various embodiments, for example, the microcontroller 101 may use control bus 108 to select, using multiplexer 102, which, if any, of microphones 106-107 to enable for use with microphone 105. Certain embodiments provide that microphones 105-107 are connected to multiplexer 102 and the microcontroller 101 may use control bus 108 to select, using multiplexer 102, which of microphones 105-107 to enable for use. In certain embodiments, audio samples from the three microphones 105-107 may be provided to the microcontroller 101 over the bus 109 and the microcontroller may select the microphone(s) by determining which one or more audio samples to use, for example.

In certain embodiments, the microcontroller 101 changes the microphone combination and/or mode at step 204 when the detected change in three-dimensional orientation at step 203 is stable over a predetermined number of polling periods. For example, if the predetermined number of polling periods is two polling periods, the microcontroller 101 may select a different microphone combination and/or mode at step 204 when the microcontroller 101 receives position data from position sensor(s) 104 over two polling periods indicating that the orientation of the companion microphone unit 100 has changed such that the selected microphone combination and/or mode should also change.

At 205, if the companion microphone unit 100 position has not changed such that a different one or combination of microphones would provide better performance than the current microphone or combination of microphones (e.g., the default or previously-selected microphone(s)), as indicated by step 203, the microcontroller 101 continues using the default or previously-selected microphone combination and/or mode. For example, as discussed above with regard to FIGS. 7-8 and 12-13, if the position of the companion microphone unit 100 has not substantially changed, the default or previously-selected orientation may continue to represent the optimal microphone combination and/or mode selection.

At 206, the audio input from the selected microphone(s) is received. In certain embodiments, for example, microphone(s) enabled by microcontroller 101 using multiplexer 102 may be provided to CODEC 103, which converts the analog signals received from microphone(s) to digital audio samples. The digital audio samples may be provided to microcontroller 101 via bus 109.

As another example, audio samples from the three microphones 105-107 may be provided to the microcontroller 101 over the bus 109 and the microcontroller may select the microphone(s) by determining which one or more audio samples to use, for example. The selected audio samples may be the received microphone input, for example.

In operation, utilizing a method 200 such as that described in connection with FIG. 14 in accordance with embodiments of the present technology can enhance speech intelligibility, for example, by adapting the microphone configuration of the companion microphone unit to a detected position of the companion microphone unit.

Accordingly, the present invention may be realized in hardware, software, or a combination thereof. The present invention may be realized in a centralized fashion in at least one computer system, or in a distributed fashion where different elements may be spread across several interconnected computer systems. Any kind of computer system or other apparatus adapted for carrying out the methods described herein may be suited. A typical combination of hardware and software may be a general-purpose computer system with a computer program that, when being loaded and executed, may control the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

Certain embodiments provide a companion microphone system 100 comprising a plurality of microphones 105-107, a position sensor 104 and a microcontroller 101. The position sensor 104 is configured to generate position data corresponding to a position of the companion microphone system 100. The plurality of microphones 105-107 and the position sensor 104 comprise a fixed relationship in three-dimensional space. The microcontroller 101 is configured to receive the position data from the position sensor 104 and select at least one of the plurality of microphones 105-107 to receive an audio input based on the received position data.

In certain embodiments, the plurality of microphones 105-107 is three microphones.

In various embodiments, the microcontroller 101 selects two of the plurality of microphones 105-107 in a specified order.

In certain embodiment, the plurality of microphones 105-107 is omni-directional microphones.

In various embodiments, the companion microphone system 100 comprises a multiplexer 102 configured to enable the selected at least one microphone based on the selection of the microcontroller 101.

In certain embodiments, the companion microphone system 100 comprises a coder/decoder 103 configured to receive the audio input from the selected at least one of the plurality of microphones 105-107 and convert the received audio input into a digital audio input.

In various embodiments, the generated position data comprises a plurality of sets of position data, each of the plurality of sets of position data generated at a different polling time.

In certain embodiments, the microcontroller 101 selection of the at least one of the plurality of microphones 105-107 to receive the audio input occurs after receiving a plurality of sets of position data that consistently indicate that a same at least one of the plurality of microphones 105-107 should be selected.

In various embodiments, the companion microphone system 100 comprises an attachment mechanism 110 for detachably coupling to a user of the companion microphone system 100.

In certain embodiments, the generated position data corresponds to a three-dimensional position of the companion microphone system 100.

In various embodiments, the microcontroller 101 selection of the two of the plurality of microphones 105-107 in the specified order provides at least one of a ninety degree rotation and a one hundred and eighty degree rotation of a polar pattern corresponding to the companion microphone system 100.

Various embodiments provide a method 200 for adapting a microphone configuration of a companion microphone system 100. The method comprises polling 201 a position sensor 104 for position data corresponding to a position of the companion microphone system 100. The method also comprises determining 202 the position of the companion microphone system 100 based on the position data. Further, the method comprises selecting 204 at least one microphone of a plurality of microphones 105-107 based on the position data. The method further comprises receiving 206 an audio input from the selected at least one microphone of the plurality of microphones 105-107.

In certain embodiments, the method 200 comprises continuously repeating the polling 201 and determining 202 steps at a predetermined polling time interval.

In various embodiments, the predetermined polling time interval is approximately one second.

In certain embodiments, the method 200 comprises changing 204 the selected at least one microphone to a different selected at least one microphone of the plurality of microphones 105-107 if the position of the companion microphone system 100 substantially changes. The method further comprises using 205 the selected at least one microphone if the position of the companion microphone system 100 does not substantially change.

In various embodiments, the plurality of microphones 105-107 is three microphones.

In certain embodiments, the selected at least one microphone is two of the plurality of microphones 105-107 in a specified order.

In various embodiments, the plurality of microphones 105-107 is omni-directional microphones.

In certain embodiments, the position data comprises a plurality of sets of position data, each of the plurality of sets of position data generated at a different polling time.

In various embodiments, the selection of the at least one of the plurality of microphones 105-107 occurs after receiving a plurality of sets of position data that consistently indicate that a same at least one of the plurality of microphones 105-107 should be selected.

In certain embodiments, the position data corresponds to a three-dimensional position of the companion microphone system 100.

In various embodiments, the selection of the two of the plurality of microphones 105-107 in the specified order provides at least one of a ninety degree rotation and a one hundred and eighty degree rotation of a polar pattern corresponding to the companion microphone system 100.

Certain embodiments provide a non-transitory computer-readable medium encoded with a set of instructions for execution on a computer. The set of instructions comprises a polling routine configured to poll 201 a position sensor 104 for position data corresponding to a position of a companion microphone system 100. The set of instructions also comprises a position determination routine configured to determine 202 the position of the companion microphone system 100 based on the position data. The set of instructions further comprises a microphone selection routine configured to select 204 at least one microphone of a plurality of microphones 105-107 based on the position data. Further, the set of instructions comprises an audio input receiving routine configured to receive 206 an audio input from the selected at least one microphone of the plurality of microphones 105-107.

In various embodiments, the polling routine and position determination routine are continuously repeated at a predetermined polling time interval.

In certain embodiments, the predetermined polling time interval is approximately one second.

In various embodiment, the non-transitory computer-readable medium encoded with the set of instructions comprises a selection change routine configured to change 204 the selected at least one microphone to a different selected at least one microphone of the plurality of microphones 105-107 if the position of the companion microphone system 100 substantially changes. The non-transitory computer-readable medium encoded with the set of instructions also comprises a no-change routine configured to use 205 the selected at least one microphone if the position of the companion microphone system 100 does not substantially change.

In certain embodiments, the plurality of microphones 105-107 is three microphones.

In various embodiments, the at least one microphone selected by the microphone selection routine is two of the plurality of microphones 105-107 in a specified order.

In certain embodiments, the plurality of microphones 105-107 is omni-directional microphones.

In various embodiments, the position data comprises a plurality of sets of position data, each of the plurality of sets of position data generated at a different polling time by the polling routine.

In certain embodiments, the microphone selection routine occurs after receiving a plurality of sets of position data that consistently indicate that a same at least one of the plurality of microphones 105-107 should be selected.

In various embodiments, the position data corresponds to a three-dimensional position of the companion microphone system 100.

In certain embodiments, the two of the plurality of microphones 105-107 in the specified order selected by the microphone selection routine provides at least one of a ninety degree rotation and a one hundred and eighty degree rotation of a polar pattern corresponding to the companion microphone system 100.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A companion microphone system comprising:

a plurality of microphones, wherein the plurality of microphones is at least three microphones;

a position sensor configured to generate position data corresponding to a position of the companion microphone system, wherein the plurality of microphones and the position sensor comprise a fixed relationship in three-dimensional space; and a microcontroller configured to receive the position data from the position sensor and select two of the plurality of microphones in a specified directional order to receive an audio input based on the received position data, wherein the microcontroller selection of the two of the plurality of microphones in the specified directional order provides at least one of a ninety degree rotation and a one hundred and eighty degree rotation of a polar pattern corresponding to the companion microphone system.

2. The system of claim 1, wherein a first microphone and a second microphone are arranged parallel to a side of the companion microphone system, and wherein a third microphone and the second microphone are arranged perpendicular to the side of the companion microphone system.

3. The system of claim 1, wherein the plurality of microphones is omni-directional microphones.

4. The system of claim 1, comprising a multiplexer configured to enable the selected two of the plurality of microphones based on the selection of the microcontroller.

5. The system of claim 1, comprising a coder/decoder configured to receive the audio input from the selected two of the plurality of microphones and convert the received audio input into a digital audio input.

6. The system of claim 1, wherein the generated position data comprises a plurality of sets of position data, each of the plurality of sets of position data generated at a different polling time.

7. The system of claim 6, wherein the microcontroller selection of the two of the plurality of microphones to receive the audio input occurs after receiving a plurality of sets of position data that consistently indicate that a same two of the plurality of microphones should be selected.

8. The system of claim 1, comprising an attachment mechanism for detachably coupling to a user of the companion microphone system.

9. The system of claim 1, wherein the generated position data corresponds to a three-dimensional position of the companion microphone system.

10. A method for adapting a microphone configuration of a companion microphone system comprising:

polling a position sensor for position data corresponding to a position of the companion microphone system;

determining the position of the companion microphone system based on the position data;

selecting two of a plurality of microphones in a specified directional order based on the position data, wherein the plurality of microphones is at least three microphones; and receiving an audio input from the selected two of the plurality of microphones, wherein the selection of the two of the plurality of microphones in the specified directional order provides at least one of a ninety degree rotation and a one hundred and eighty degree rotation of a polar pattern corresponding to the companion microphone system.

11. The method of claim 10, comprising continuously repeating the polling and determining steps at a predetermined polling time interval.

12. The method of claim 11, wherein the predetermined polling time interval is approximately one second.

13. The method of claim 11, comprising changing the selected two microphones to one or more of a different combination of two of the plurality of microphones or a different specified directional order of the selected microphones if the position of the companion microphone system changes.

14. The method of claim 11, wherein the position data comprises a plurality of sets of position data, each of the plurality of sets of position data generated at a different polling time.

15. The method of claim 14, wherein the selection of the two of the plurality of microphones occurs after receiving a plurality of sets of position data that consistently indicate that a same two of the plurality of microphones should be selected.

16. The method of claim 10, wherein a first microphone and a second microphone are arranged parallel to a side of the companion microphone system, and wherein a third microphone and the second microphone are arranged perpendicular to the side of the companion microphone system.

17. The method of claim 10, wherein the plurality of microphones is omni-directional microphones.

18. The method of claim 10, wherein the position data corresponds to a three-dimensional position of the companion microphone system.

19. A non-transitory computer-readable medium encoded with a set of instructions for execution on a computer, the set of instructions comprising:

a polling routine configured to poll a position sensor for position data corresponding to a position of a companion microphone system;

a position determination routine configured to determine the position of the companion microphone system based on the position data;

a microphone selection routine configured to select two of a plurality of microphones in a specified directional order based on the position data, wherein the plurality of microphones is at least three microphones; and an audio input receiving routine configured to receive an audio input from the selected two of the plurality of microphones, wherein the two of the plurality of microphones in the specified directional order selected by the microphone selection routine provides at least one of a ninety degree rotation and a one hundred and eighty degree rotation of a polar pattern corresponding to the companion microphone system.

20. The non-transitory computer-readable medium encoded with the set of instructions of claim 19, wherein the polling routine and position determination routine are continuously repeated at a predetermined polling time interval.

21. The non-transitory computer-readable medium encoded with the set of instructions of claim 20, wherein the predetermined polling time interval is approximately one second.

22. The non-transitory computer-readable medium encoded with the set of instructions of claim 20, comprising a selection change routine configured to change the selected two microphones to one or more of a different combination of two of the plurality of microphones or a different specified directional order of the selected microphones if the position of the companion microphone system changes.

23. The non-transitory computer-readable medium encoded with the set of instructions of claim 20, wherein the position data comprises a plurality of sets of position data, each of the plurality of sets of position data generated at a different polling time by the polling routine.

24. The non-transitory computer-readable medium encoded with the set of instructions of claim 23, wherein the microphone selection routine occurs after receiving a plurality of sets of position data that consistently indicate that a same two of the plurality of microphones should be selected.

25. The non-transitory computer-readable medium encoded with the set of instructions of claim 19, wherein a first microphone and a second microphone are arranged parallel to a side of the companion microphone system, and wherein a third microphone and the second microphone are arranged perpendicular to the side of the companion microphone system.

26. The non-transitory computer-readable medium encoded with the set of instructions of claim 19, wherein the plurality of microphones is omni-directional microphones.

27. The non-transitory computer-readable medium encoded with the set of instructions of claim 19, wherein the position data corresponds to a three-dimensional position of the companion microphone system.

* * * * *